US009562332B2

(12) United States Patent
Erwe et al.

(10) Patent No.: US 9,562,332 B2
(45) Date of Patent: Feb. 7, 2017

(54) METHOD FOR PRODUCING BALLAST BODIES

(75) Inventors: Torsten Erwe, Odenthal (DE); Frank Grimberg, Dormagen (DE); Thomas Gross, Wermelskirchen (DE); Thomas Kleiner, Odenthal (DE)

(73) Assignee: Covestro Deutschland AG, Leverkusen (DE)

( * ) Notice: Subject to any disclaimer, the term of this patent is extended or adjusted under 35 U.S.C. 154(b) by 575 days.

(21) Appl. No.: 14/241,991

(22) PCT Filed: Aug. 27, 2012

(86) PCT No.: PCT/EP2012/066598

§ 371 (c)(1),
(2), (4) Date: Jun. 24, 2014

(87) PCT Pub. No.: WO2013/030149

PCT Pub. Date: Mar. 7, 2013

(65) Prior Publication Data

US 2014/0300015 A1 Oct. 9, 2014

(30) Foreign Application Priority Data

Sep. 1, 2011 (DE) ..... 10 2011 081 991

(51) Int. Cl.
*E01B 27/02* (2006.01)
*E01B 3/44* (2006.01)
*E01B 1/00* (2006.01)

(52) U.S. Cl.
CPC ..... *E01B 27/02* (2013.01); *E01B 1/001* (2013.01); *E01B 3/44* (2013.01)

(58) Field of Classification Search
CPC ..... E01B 3/44; E01B 27/02
See application file for complete search history.

(56) References Cited

U.S. PATENT DOCUMENTS 3,360,495 A 12/1967 Muller et al.
3,383,351 A 5/1968 Stamberger
(Continued)

FOREIGN PATENT DOCUMENTS

DE 1168075 B 4/1964
DE 86201 A 7/1971
(Continued)

OTHER PUBLICATIONS

International Search Report for PCT/EP2012/066598 mailed Jan. 7, 2013.

*Primary Examiner* — Benjamin Schiffman
(74) *Attorney, Agent, or Firm* — K&L Gates LLP

(57) ABSTRACT

The invention relates to a method for producing load transferring regions in a ballast body of a track superstructure by introducing curable liquid plastics or reactive plastic mixtures from a mixing unit by means of at least two distributor pipes with outlets into the load transferring regions and allowing the plastic or the reactive plastic mixture to cure in said load transferring regions. The two distributor pipes with outlets are positioned on the left or on the right from the outside of the rails into the region between the two rails such that the outlets are located adjacent to each other and are laterally spaced from the front face (3) of the tie (2) that has the load transferring region to be reinforced. The two outlets are opened in order to allow the plastic or the reactive plastic mixture to exit at a controlled rate. Each distributor pipe outlet is guided to the respective end face (4, 4') of the tie (2) from the inside to the outside in a lateral manner with respect to the front face (3) of the tie (2) and around the respective end face (4, 4') of the tie (2) to the rear face (5) of the tie (2). The distributor pipe outlets are guided in a lateral manner along the rear face (5) of the tie (2) into the region between the two rails (9, 9') such that the outlets are located adjacent
(Continued)

to each other and are laterally spaced from the rear face (5) of the tie (2).

1 Claim, 4 Drawing Sheets

(56) References Cited

U.S. PATENT DOCUMENTS

| | | | | |
|---|---|---|---|---|
| 4,985,276 | A | 1/1991 | Zeiss et al. | |
| 5,372,844 | A | 12/1994 | Ihle et al. | |
| 2009/0152368 | A1 | 6/2009 | Frenzel | |
| 2010/0140367 | A1 | 6/2010 | Pawlik et al. | |
| 2015/0292167 | A1* | 10/2015 | Erwe ..... | E01B 27/02 104/2 |

FOREIGN PATENT DOCUMENTS

| | | | |
|---|---|---|---|
| DE | 2063727 | A1 | 8/1972 |
| DE | 2305536 | A1 | 8/1974 |
| DE | 3821963 | A1 | 1/1990 |
| DE | 3941142 | A1 | 6/1991 |
| DE | 19651755 | A1 | 6/1998 |
| DE | 19711437 | A1 | 10/1998 |
| DE | 19811838 | A1 | 9/1999 |
| EP | 0822293 | A1 | 2/1998 |
| EP | 1619305 | A2 | 1/2006 |
| JP | 8157552 | | 6/1996 |
| JP | 10266105 | | 10/1998 |
| WO | WO-91/08056 | A1 | 6/1991 |
| WO | WO-2007090901 | A2 | 8/2007 |
| WO | WO-2008128665 | A1 | 10/2008 |
| WO | WO-2009068169 | A1 | 6/2009 |

* cited by examiner

METHOD FOR PRODUCING BALLAST BODIES

RELATED APPLICATIONS

This application is a national stage application (under 35 U.S.C. §371) of PCT/EP2012/066598, filed Aug. 27, 2012, which claims benefit of German Application No. 10 2011 081 992.6, filed Sep. 1, 2011, which is incorporated by reference herein.

The present invention relates to a process for the production of ballast comprising ballast stones and plastics for railway track laying, said ballast having a high stability and long service life.

In recent years there has been a sharp increase in the demand for ballast used in railway track laying and road construction. One reason for this is of course the general increase in the mobility of the population and in freight traffic. In rail traffic in particular, more and more trains are running at high speed and high axle load. The enormous displacement forces that result are transmitted via the rails to the sleepers and from there to the ballast. Over time the stones change shape and individual ballast stones are twisted, shifted and rounded, changing the position of the track and making it necessary to carry out cost-intensive and time-consuming repairs at regular intervals.

Various methods of consolidating ballast by including plastics have already been described in the past (DD-A1 86201, DE-A 2063727, DE-A 2305536, DE-A1 3941142, DE-A1 19711437, DE-A1 19651755, DE-A1 3821963, DE-A 19811838, JP-A 08157552).

DE-A 2063727 describes a method of reducing lateral buckling of the track due to transverse displacement forces, wherein the binder in the form of a high-viscosity plastic is sprayed on to the ballast bed and the ballast stones are adhesively bonded at the points of contact. Alternatively, the ballast stones can be adhesively bonded in a plane by injecting the binder in the form of a 2-component synthetic resin.

DE-A 2305536 describes a method of raising railway sleepers and road surfaces by introducing a swelling agent which then solidifies. The swelling agent is e.g. a multicomponent plastic such as polyurethane foam. The liquid plastic is applied through a hole in the sleeper by means of a filling probe.

JP-A 8157552 describes the preparation of polyurethane resins which cure in the presence of moisture and are used to stabilize piles of stones. The polyurethane resins are prepared using aromatic polyisocyanates, monofunctional polyethers and amine-initiated polyethers and are applied by means of spraying processes.

A common feature of all known processes is that they produce ballast which can only be stabilized non-selectively with the aid of plastics. Furthermore, in some cases the described processes rely on a relatively complicated application technology.

WO 2008/128665 A1 describes a method, according to the precharacterizing clause of claim 1, of using a reactive plastic to partially or completely foam the voids in the cage of a ballast bed, with a subgrade arranged underneath, wherein the reactive components are mixed in a high-pressure mixer and wherein the initiation time for the reactive mixture is adjusted so that the foaming process essentially begins only when the reactive mixture has reached the subgrade.

EP-A2 1619305 describes a method of erecting a superstructure for a rail line on a substrate that slopes across the direction in which the latter extends, wherein an elastic drainage mat is arranged on the substrate, ballast comprising individual ballast stones with voids in between is formed on the drainage mat, sleepers are embedded in the ballast, track is fixed to the sleepers and, to fix the position of the ballast stones located essentially only within load transfer regions of the ballast underneath the sleepers, a foamable material is introduced into the voids between said stones. The foamable material is introduced with foam lances sunk into the ballast.

WO 2009/068169 A1 describes a method of consolidating a ballast bed in the upper region of which are arranged sleepers with rails fixed thereto, the ballast bed having, underneath the sleepers, load transfer regions which take up loads acting on the rails and transfer them to a body of earth located underneath the ballast bed, wherein voids in the cage of the ballast bed are foamed with a foam formed from a reactive mixture, the reactive mixture being introduced into the cage in an amount such that the cage is filled with foam from the surface of the body of earth to the underside of the sleepers, at least in the load transfer regions, and such that the foam which expands during foaming is spatially limited in that there is a covering on or above the ballast bed before the foaming process ends.

WO 2007/090901 A2 describes a method of introducing a flowable, foamable reaction mixture from the top into a ballast with sleepers embedded therein, wherein the mixture is introduced into the ballast at the side of the sleepers, the mixture being adjusted so that the foaming process only begins when the front of the mixture flowing downwards within the ballast has reached the underside or the region near the underside of the ballast, so that the foaming takes place from bottom to top within the ballast.

The disadvantage of these methods is that the introduction of the stabilizing foam is too complex and does not allow the advance work to be carried out at a speed commensurate with everyday track laying.

The object of the present invention was therefore to provide an improved process for the production of ballast which makes it possible to stabilize the ballast and at the same time ensures a long service life, and which does not exhibit the aforementioned disadvantages.

The object according to the invention could be achieved by providing the process according to the invention described below.

The invention provides a process for the production of load transfer regions strengthened with plastic, especially polyurethane, in a ballast, containing ballast stones and, in parts, plastic, especially polyurethane foam, of a superstructure which consists of at least ballast, sleepers and rails, by introducing liquid, curable plastics or plastic reactive mixtures, especially polyurethane reactive mixtures, into the load transfer regions from a mixer unit by means of at least two distributing pipes with outlets, and leaving the plastic or plastic reactive mixture, especially polyurethane reactive mixture, to cure and optionally foam in these load transfer regions, characterized in that, to introduce the plastic or plastic reactive mixture, especially polyurethane reactive mixture, 1) the two distributing pipes with outlets are positioned on the left or right from outside the rails (1,1'), preferably underneath the rails, until they reach the region between the two rails (6,6'), so that the outlets are next to one another and laterally at a distance from the front (3) of the sleeper (2) whose load transfer region is to be strengthened, 2) the two outlets are opened to allow plastic or plastic reactive mixture, especially polyurethane reactive mixture, to flow out in a regulated amount,
3) the outlets of the distributing pipes, each at the side of the front (3) of the sleeper (2), are guided from the inside to the outside up to the respective end (4,4') of the sleeper (2) and around the respective end (4,4') of the sleeper up to the back (5) of the sleeper (2),
4) the outlets of the distributing pipes are guided, preferably underneath the rails, laterally along the back (5) of the sleeper (2) until they reach the region between the two rails (9,9'), so that the outlets are next to one another and laterally at a distance from the back (5) of the sleeper (2) whose load transfer region is to be strengthened,
5) the outlets are optionally closed and
6) the outlets of the distributing pipes are guided to another sleeper and the process (steps 2) to 6)) is repeated at this sleeper.

Figure 1:
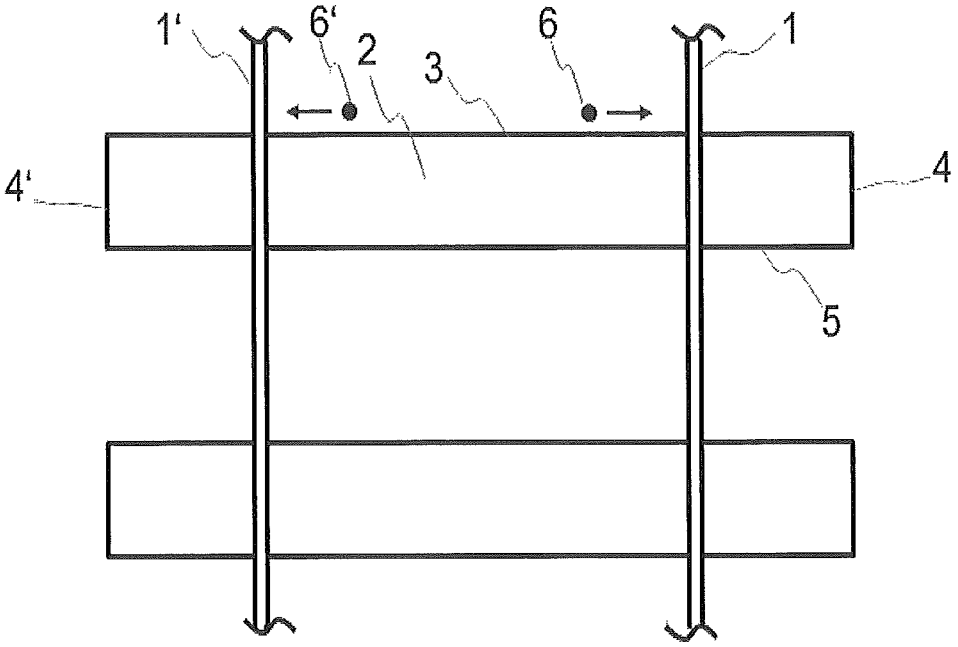
FIG. 1 depicts a superstructure viewed from above, with outlets at 6 and 6' position.

The distributing pipes preferably consist of a leg running approximately perpendicular to the surface of the ballast bed, and a leg running approximately level with the surface of the ballast bed. The length of the level leg of the distributing pipe should be at least sufficient to reach the region between the two parallel rails without the perpendicular leg touching the rails.

At their outlet the distributing pipes are preferably bent slightly towards the ballast bed in order to simplify the outflowing and precise discharging of the plastic or plastic reactive mixture.

The amount of plastic or plastic reactive mixture flowing out of the distributing pipes can vary according to their position. This is preferably controlled electronically.

The distributing pipes can be rigid, flexible or extendable. If extendable, the distributing pipe itself is lengthened or shortened, but must not be moved as a whole.

Preferably, flexible plastic tubes can be inserted in the distributing pipes; these can easily be replaced in the event of a blockage.

If necessary, the distributing pipes can be cleaned between the mixer unit and the appropriate outlet by means of compressed air.

The distributing pipes can preferably be fixed with the mixer unit to a robot or a portal with three linear axes, which controls the position of the outlet of the distributing pipes in the manner described above.

The distributing pipes are preferably guided to the next sleeper.

The outlets of the distributing pipes are preferably moved parallel to the sleeper (at the front and back) at a speed preferably of 5 to 2000 mm/s, particularly preferably of 30 to 500 mm/s. Particularly preferably, the speed along the sleeper can be varied dynamically.

The outlets of the distributing pipes at the end of the sleeper are moved at a speed preferably of 5 to 2000 mm/s, particularly preferably of 100 to 1000 mm/s. Although it is possible to vary the speed dynamically along the end, it is preferable not to do so.

The amount of reactive mixture flowing out of the distributing pipes and the speed at which the outlet of the distributing pipes advances are preferably coordinated so that the amount of plastic or reactive mixture discharged is always sufficient to adequately strengthen and, preferably, foam the load transfer regions. This makes it possible, for example, to accommodate different distances between sleepers and local changes and circumstances, as well as curves, without the need to stop working.

The distances between sleepers are often different in practice and are therefore preferably determined with a measuring device, preferably electronically, so that the outlets of the distributing pipes can be positioned accordingly.

The distributing pipes with outlets and optionally the robot/portal with three linear axes can be fixed to a mobile portal, which is preferably moved on the rails.

The plastic or plastic reactive mixture used is preferably an epoxide or very particularly preferably a polyurethane reactive mixture. The cured polyurethane is preferably polyurethane foam.

Preferably, the polyurethane reactive mixture used by choice contains a mixture of a) one or more isocyanate compounds from the group comprising polyisocyanates with an NCO content of 28 to 50 wt % and NCO prepolymers with an NCO content of 10 to 48 wt %, and polyether polyols with a hydroxyl number of 6 to 112, polyoxyalkylene diols with a hydroxyl number of 113 to 1100 or alkylene diols with a hydroxyl number of 645 to 1850, or mixtures thereof, and
b) a polyol component consisting of one or more polyether polyols with a hydroxyl number of 6 to 112 and a functionality of 1.8 to 8, in the presence of
c) 0 to 26 wt %, based on reactants b) to g), of one or more chain extenders with a hydroxyl or amine number of 245 to 1850 and a functionality of 1.8 to 8,
d) 0.05 to 5 wt %, based on reactants b) to g), of one or more blowing agents,
e) 0 to 5 wt %, based on reactants b) to g), of one or more catalysts,
f) 0 to 50 wt %, based on reactants b) to g), of one or more fillers and
g) 0 to 25 wt %, based on reactants b) to g), of one or more auxiliary substances and/or additives, the index of the reaction mixture being in the range from 70 to 130.

The index is understood as meaning the equivalent ratio of NCO groups to OH groups and NH groups, multiplied by 100. Thus, for example, an index of 110 signifies that there are 1.1 reactive NCO groups from the isocyanate compounds per reactive OH group or NH group, or that there is 0.91 reactive OH group or NH group per reactive NCO group from the isocyanate compounds.

The components for preparing the polyurethane foams are used in a mixing ratio that allows homogeneous mixing of the components, especially when using high-pressure machines. The use of high-pressure machines also enables fast-reacting PUR systems to be processed, thereby making the process economic. By using the raw materials described in greater detail below, it is additionally possible to optimize the processing properties of the PUR system according to requirements. Thus, a partial foaming of the ballast using the pouring technique is a practicable application method. Furthermore, the mechanical properties of the polyurethane foams used can be varied within wide limits. The advantages of the PUR foams used are good compressive strengths (at 10% compression set) (≥10.0 N), good compression hardnesses (at 10% compression set) (≥1.0 kPa) and good tensile strengths (≥0.1 MPa), coupled with a low permanent set (PS (40%, 25° C., 5 min)≤0.01%).

The polyurethane foams are preferably prepared in the presence of chain extenders and catalysts, it being preferable to use catalysts having primary and/or secondary hydroxyl and/or amino groups. The polyurethanes obtained in this way show better emission behaviour and, after extraction with solvents (e.g. water), are distinguished by containing a reduced proportion of mobilizable ingredients. The polyurethane foams according to the invention can optionally also contain fillers, auxiliary substances and additives known per se from polyurethane chemistry.

With regard to processing, the reaction mixture for preparing the polyurethane foam is adjusted so that it can be used by a simple application technique (e.g. the pouring method). For example, the ballast can be partially foamed by specifically adjusting the reactivity of the reaction mixture. Such partial foaming on the one hand allows selective strengthening in particularly stressed sections of the ballast (e.g. curves, load transfer regions) and on the other hand allows liquids, e.g. water, to drain freely. If the reaction were too slow, the reaction mixture would flow away into the ground or into lateral regions of the ballast bed. If the reaction were too fast, the reaction mixture would not penetrate deeply enough into the layer of bulk material. For example, the initiation time of the reaction mixture for a track system with a ballast depth of approx. 40 cm should be 1 to 15 seconds, preferably 1 to 5 seconds, and the setting time should be 15 to 45 seconds, preferably 15 to 30 seconds, longer setting times being possible but uneconomic.

The polyurethane foam used should preferably have a compressive strength (at 10% compression set) of at least 10.0 N, a compression hardness (at 10% compression set) of at least 1.0 kPa and a tensile strength of at least 0.1 MPa. In addition, it should preferably have a permanent set (PS) (40%, 25° C., 5 min) of at most 0.01% and a good stability to weathering or hydrolysis. The polyurethane foam used should also be distinguished by containing the minimum proportion of emissible and mobilizable ingredients.

The polyisocyanates a) used are (cyclo)aliphatic or aromatic polyisocyanates, preference being afforded to toluylene diisocyanate and di- and/or polyisocyanates of the diphenylmethane series having an NCO content of 28 to 50 wt %. These include mixtures of 4,4'-diisocyanatodiphenylmethane with 2,4'- and optionally a small amount of 2,2'-diisocyanatodiphenylmethane which are liquid at room temperature and have optionally been appropriately modified. Other suitable polyisocyanates are polyisocyanate mixtures of the diphenylmethane series which are liquid at room temperature, contain not only the isomers mentioned but also their higher homologues, and are obtainable in a manner known per se by the phosgenation of aniline-formaldehyde condensates. Modified products of these di- and polyisocyanates containing urethane or carbodiimide groups and/or allophanate or biuret groups are also suitable.

NCO prepolymers with an NCO content of 10 to 48 wt % are also suitable as component a). They are prepared from the aforementioned polyisocyanates and polyether polyols with a hydroxyl number of 6 to 112, polyoxyalkylene diols with a hydroxyl number of 113 to 1100 or alkylene diols with a hydroxyl number of 645 to 1850, or mixtures thereof.

Components b) are polyhydroxy polyethers which can be prepared in a manner known per se by the polyaddition of alkylene oxides on to polyfunctional starter compounds in the presence of catalysts. Preferably, the polyhydroxy polyethers are prepared from a starter compound having an average of 2 to 8 active hydrogen atoms, and one or more alkylene oxides. Preferred starter compounds are molecules having two to eight hydroxyl groups per molecule, such as water, ethylene glycol, propylene glycol, diethylene glycol, dipropylene glycol, triethylene glycol, tripropylene glycol, 1,4-butanediol, 1,6-hexanediol, triethanolamine, glycerol, trimethylolpropane, pentaerythritol, sorbitol and sucrose. The starter compounds can be used on their own or in a mixture. The polyols b) are prepared from one or more alkylene oxides. The alkylene oxides used are preferably oxirane, methyl-oxirane and ethyloxirane. These can be used on their own or in a mixture. If the alkylene oxides are used in a mixture, they can be reacted randomly and/or blockwise. Higher-molecular polyhydroxy polyethers in which high-molecular polyadducts/polycondensates or polymers are in finely dispersed, dissolved or grafted form are also suitable. Polyhydroxyl compounds modified in this way are obtained e.g. by allowing polyaddition reactions (e.g. between polyisocyanates and amino-functional compounds) or polycondensation reactions (e.g. between formaldehyde and phenols and/or amines) to take place in situ in the compounds b) containing hydroxyl groups (as described e.g. in DE-AS 1 168 075). Polyhydroxyl compounds modified by vinyl polymers, such as those obtained e.g. by polymerizing styrene and acrylonitrile in the presence of polyethers (e.g. according to U.S. Pat. No. 3,383,351), are also suitable as polyol component b) for the process according to the invention. Representatives of said component b) are described e.g. in Kunststoff-Handbuch, Volume VII "Polyurethane", 3rd edition, Carl Hanser Verlag, Munich/Vienna, 1993, pages 57-67 or pages 88-90.

The polyol component b) used preferably consists of one or more polyhydroxy polyethers having a hydroxyl number of 6 to 112, preferably of 21 to 56, and a functionality of 1.8 to 8, preferably of 1.8 to 6.

Suitable chain extenders c) are those having a mean hydroxyl or amine number of 245 to 1850 and a functionality of 1.8 to 8, preferably of 1.8 to 3. Examples which may be mentioned here are ethylene glycol, propylene glycol, diethylene glycol, dipropylene glycol, 1,4-butanediol, 1,6-hexanediol, triethanolamine, glycerol, tri-methylolpropane and short-chain alkoxylation products. Component c) is preferably used in amounts of 0 to 26 wt %, based on reactants b) to g). It is particularly preferable to use ethylene glycol, 1,4-butanediol, the propoxylation product of trimethylolpropane (OH number: 550) and mixtures of triethanolamine and diisopropanolamine (OH number: 1160).

Blowing agents d) which can be used are both physical blowing agents and water. Preferred physical blowing agents d) are 1,1-difluoroethane (HFC-152a), 1,1,1,2-tetrafluoroethane (HFC-134a), 1,1,1,2,3,3,3-heptafluoropropane (HFC-227ea), 1,1,1,3,3-pentafluoropropane (HFC-245fa), 1,1,1,3,3-pentafluorobutane (HFC-365mfc), n-pentane, i-pentane, i-hexane or mixtures thereof. Particularly preferably, water is used as component d). The blowing agents can be used on their own or in combination and are present in amounts of 0.05 to 5 wt %, particularly preferably in amounts of 0.3 to 3.5 wt %, based on reactants b) to g).

The inherently slow reaction between isocyanate and hydroxyl groups can be accelerated by adding one or more catalysts e). These can be especially tertiary amines of the type known per se, e.g. triethylamine, tributylamine, N-methyl-morpholine, N-ethylmorpholine, N-cocomorpholine, N,N,N',N'-tetramethyl-ethylenediamine, 1,4-diazabicyclo [2.2.2]octane, N-methyl-N'-dimethylamino ethyl-piperazine, N,N-dimethylcyclohexylamine, N,N,N',N'-tetramethyl-1,3-butane-diamine, N,N-dimethylimidazole-β-phenylethylamine, 1,2-dimethylimidazole, bis-(2-dimethylaminoethyl) ether or 2-methylimidazole. It is also possible to use organic metal catalysts, such as organic bismuth catalysts, e.g. bismuth(III) neodecanoate, or organic tin catalysts, e.g. tin(II) salts of carboxylic acids, such as tin(II) acetate, tin(II) octanoate, tin(II) ethylhexanoate and tin(II) laurate, and dialkyltin salts of carboxylic acids, such as dibutyltin diacetate, dibutyltin dilaurate, dibutyltin maleate or dioctyltin diacetate, on their own or in combination with the tertiary amines. It is preferable to use catalysts having primary and/or secondary hydroxyl and/or amino groups. These can be both incorporable amines and incorporable organic metal catalysts of the types known per se, e.g. N-(3-dimethylaminopropyl)-N,N-diisopropanolamine, N,N,N'-trimethyl-N'-hydroxyethyl-bisaminoethyl ether, tetramethyldipropylenetriamine, 3-(dimethylamino) propylurea and tin ricinoleate. The catalysts can be used on their own or in combination. The amount of catalyst or catalyst combination used is preferably 0 to 5.0 wt %, particularly preferably 0.5 to 5.0 wt %, based on reactants b) to g). Other representatives of catalysts and details of their mode of action are described in Kunststoff-Handbuch, Volume VII "Polyurethane", 3rd edition, Carl Hanser Verlag, Munich/Vienna, 1993, pages 104-110.

Fillers f) that are optionally to be used concomitantly can be both inorganic and organic fillers. Examples of inorganic fillers which may be mentioned are silicate minerals such as sheet silicates, metal oxides such as iron oxides, pyrogenically prepared metal oxides such as aerosils, metal salts such as barium sulfate, inorganic pigments such as cadmium sulfide and zinc sulfide, and glass, glass microspheres, hollow glass microspheres, etc. It is possible to use natural and synthetic fibrous minerals, such as wollastonite and glass fibres of different lengths, which can optionally be sized. Examples of organic fillers which may be mentioned are crystalline paraffins or fats, and powders based on polystyrene, polyvinyl chloride, urea-formaldehyde materials and/or polyhydrazodicarboxamides (e.g. from hydrazine and toluylene diisocyanate). Hollow microspheres of organic origin or cork can also be used. The organic or inorganic fillers can be used individually or as mixtures. The fillers f) are preferably added in amounts of 0 to 50 wt %, preferably of 0 to 30 wt %, based on reactants b) to g).

The auxiliary substances and additives g) that are optionally used concomitantly include e.g. stabilizers, colourants, flameproofing agents, plasticizers and/or monohydric alcohols.

The stabilizers used in particular are surface-active substances, i.e. compounds which serve to promote the homogenization of the starting materials and which are optionally also suitable for regulating the cell structure of the plastics. Examples which may be mentioned are emulsifiers such as the sodium salts of castor oil sulfates or fatty acids and the salts of fatty acids with amines, foam stabilizers such as siloxane-oxyalkylene copolymers, and cell regulators such as paraffins. The stabilizers used are predominantly water-soluble organopolysiloxanes. These are polydimethylsiloxane residues on to which a polyether chain of ethylene oxide and propylene oxide is grafted. The surface-active substances are preferably added in amounts of 0.01 to 5.0 wt %, preferably of 0.1 to 1.5 wt %, based on reactants b) to g).

Colourants which can be used to colour polyurethanes are organic- and/or inorganic-based dyestuffs and/or coloured pigments known per se, e.g. iron oxide and/or chromium oxide pigments and phthalocyanine- and/or monoazo-based pigments.

Examples of suitable flameproofing agents that are optionally to be used concomitantly are tricresyl phosphate, tris-2-chloroethyl phosphate, tris-chloro-propyl phosphate and tris-2,3-dibromopropyl phosphate. Apart from the halogen-substituted phosphates already mentioned, it is also possible to use inorganic flameproofing agents, e.g. hydrated aluminium oxide, ammonium polyphosphate, calcium sulfate and sodium polymetaphosphate, or amine phosphates, e.g. melamine phosphates.

Examples of plasticizers which may be mentioned are esters of polybasic, preferably dibasic, carboxylic acids with monohydric alcohols. The acid component of such esters can be derived e.g. from succinic acid, isophthalic acid, trimellitic acid, phthalic anhydride, tetra- and/or hexahydrophthalic anhydride, endomethylene-tetrahydrophthalic anhydride, glutaric anhydride, maleic anhydride, fumaric acid and/or dimeric and/or trimeric fatty acids, optionally mixed with monomeric fatty acids. The alcohol component of such esters can be derived e.g. from branched and/or unbranched aliphatic alcohols having 1 to 20 C atoms, such as methanol, ethanol, propanol, isopropanol, n-butanol, sec-butanol, tert-butanol and the various isomers of pentyl alcohol, hexyl alcohol, octyl alcohol (e.g. 2-ethylhexanol), nonyl alcohol, decyl alcohol, lauryl alcohol, myristyl alcohol, cetyl alcohol and stearyl alcohol, and/or from fatty and waxy alcohols that are naturally occurring or obtainable by the hydrogenation of naturally occurring carboxylic acids. The alcohol component can also consist of cycloaliphatic and/or aromatic hydroxyl compounds, e.g. cyclohexanol and its homologues, phenol, cresol, thymol, carvacrol, benzyl alcohol and/or phenylethanol. Other possible plasticizers are esters of the aforementioned alcohols with phosphoric acid. Optionally, phosphoric acid esters of halogenated alcohols, e.g. trichloroethyl phosphate, can also be used. In the latter case a flameproofing effect can be achieved simultaneously with the plasticizing effect. Of course, it is also possible to use mixed esters of the aforementioned alcohols and carboxylic acids. The plasticizers can also be so-called polymeric plasticizers, e.g. polyesters of adipic, sebacic and/or phthalic acid. It is also possible to use alkylsulfonic acid esters of phenol, e.g. paraffinsulfonic acid phenyl ester, as plasticizers.

Other auxiliary substances and/or additives g) that are optionally to be used concomitantly are monohydric alcohols, such as butanol, 2-ethylhexanol, octanol, dodecanol or cyclohexanol, which can optionally be used concomitantly for the purpose of bringing about a desired chain termination.

The auxiliary substances and/or additives g) are preferably added in amounts of 0 to 25 wt %, particularly preferably of 0 to 10 wt %, based on reactants b) to g). Further information on the conventional auxiliary substances and additives g) can be found in the scientific literature, e.g. in Kunststoff-Handbuch, Volume VII "Polyurethane", 3rd edition, Carl Hanser Verlag, Munich/Vienna, 1993, page 104 et seq.

In principle, the polyurethane foams can be prepared in various ways, e.g. by the one-shot process or the prepolymer process. In the one-shot process, all the components, e.g. polyols, polyisocyanates, chain extenders, blowing agents, catalysts, fillers and/or additives, are brought together and intimately mixed. In the prepolymer process, the first step is to prepare an NCO prepolymer by reacting a portion of the polyol with the whole amount of polyisocyanate, then the remainder of the polyol and optionally chain extenders, blowing agents, catalyst, fillers and/or additives are added to the resulting NCO prepolymer and the ingredients are intimately mixed. Particular preference in terms of the present invention is afforded to a process in which components b) to g) are mixed to produce a so-called "polyol component", which is then processed with the polyisocyanate and/or NCO prepolymer a). The chain extenders, blowing agents, catalysts, fillers and auxiliary substances and/or additives that are optionally to be used concomitantly are generally added to the "polyol component", as described above, although this is not absolutely necessary since components that are compatible with the polyisocyanate component a) and do not react with it can also be incorporated into said component a).

The mixture formed by thorough mixing of the reactants is applied to the ballast stones e.g. by the pouring method. Here, the feeding, dosing and mixing of the individual components or component mixtures are carried out with the devices known per se in polyurethane chemistry. The amount of mixture introduced is generally proportioned so that the polyurethane foam has a free rise density of 20 to 800 kg/m$^3$, preferably of 30 to 600 kg/m$^3$ and particularly preferably of 50 to 300 kg/m$^3$. The starting temperature of the reaction mixture applied to the ballast stones is generally chosen within the range from 20 to 80° C., preferably from 25 to 40° C. The ballast stones are optionally dried and heated before the reaction mixture is introduced. Depending on the reactants, the catalysts added and the temperature control, the foam setting time can be from 15 to 45 seconds, preferably from 15 to 30 seconds. Longer setting times are possible, but uneconomic.

The reactive components can be mixed by the so-called high-pressure or low-pressure process.

The invention is illustrated in greater detail with the aid of FIGS. 1 to 4. The ballast stones or ballast bed of the superstructure are not shown in the Figures.

FIGS. 1 to 4 are outlines of a superstructure viewed from above, showing an exemplary sequence of the different positions of the outlets of the two distributing pipes.

Figure 2:
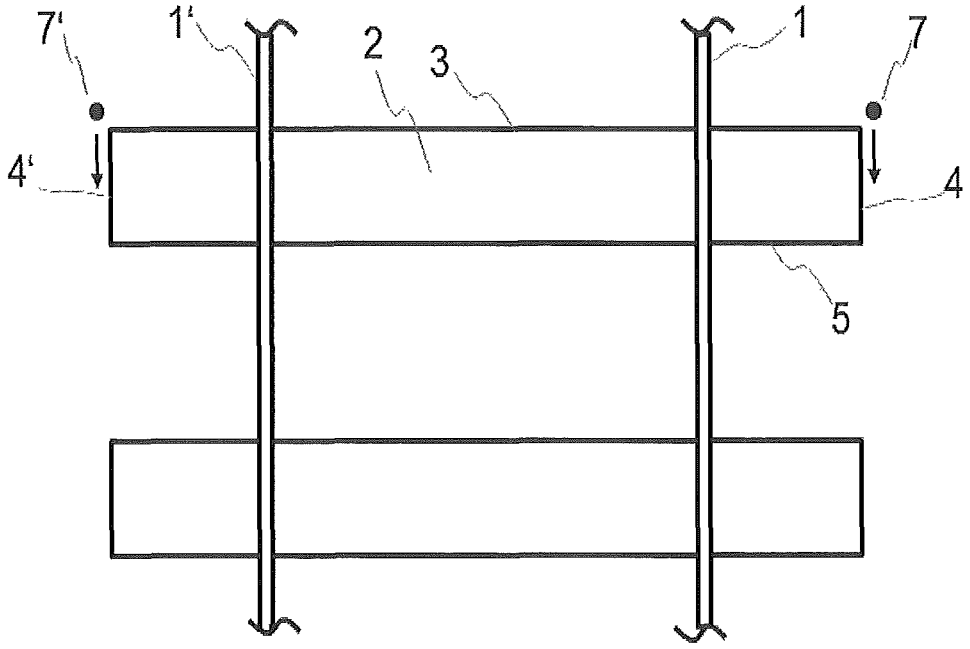
FIG. 2 depicts a superstructure viewed from above, with outlets at 7 and 7' position.
Figure 3:
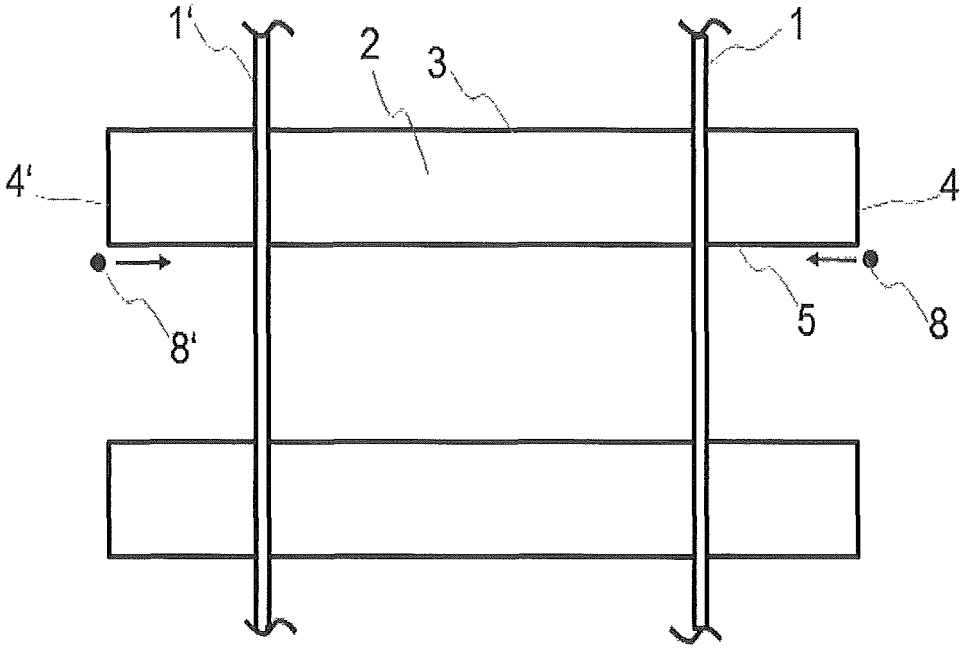
FIG. 3 depicts a superstructure viewed from above, with outlets at 8 and 8' position.
Figure 4:
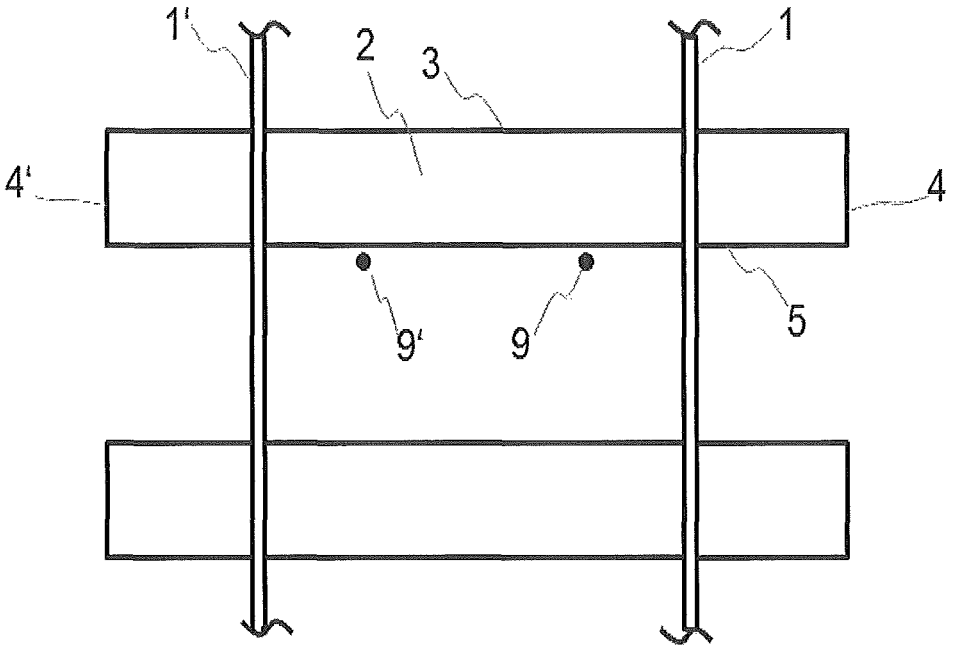
FIG. 4 depicts a superstructure viewed from above, with outlets at 9 and 9' position, The distributing pipes are preferably made of metal or plastics.

The rails 1 and 1' lie on the sleepers 2. When the plastic or plastic reactive mixture is discharged, the outlets of the distributing pipes (not shown) are driven to position 6 or 6' (FIG. 1). From there, with the plastic or plastic reactive mixture discharging, the outlets are guided laterally along the front 3 of the sleeper 2 up to position 7 or 7' (FIG. 2). They are then moved to position 8 or 8' (FIG. 3) and ultimately guided to position 9 or 9' (FIG. 4).

The invention claimed is:

1. Process for the production of load transfer regions strengthened with plastic in a ballast, containing ballast stones and, in parts, plastic, of a superstructure which consists of at least ballast, sleepers and rails, by introducing liquid, curable plastics or plastic reactive mixtures into the load transfer regions from a mixer unit by means of at least two distributing pipes with outlets, and leaving the plastic or plastic reactive mixture to cure in these load transfer regions, characterized in that, to introduce the plastic or plastic reactive mixture, 1) the two distributing pipes with outlets are positioned on the left or right from outside the rails (1,1'), preferably underneath the rails, until they reach the region between the two rails (6,6'), so that the outlets are next to one another and laterally at a distance from the front (3) of the sleeper (2) whose load transfer region is to be strengthened,
2) the two outlets are opened to allow plastic or plastic reactive mixture to flow out in a regulated amount,
3) the outlets of the distributing pipes, each at the side of the front (3) of the sleeper (2), are guided from the inside to the outside up to the respective end (4,4') of the sleeper (2) and around the respective end (4,4') of the sleeper (2) up to the back (5) of the sleeper (2),
4) the outlets of the distributing pipes are guided, preferably underneath the rails, laterally along the back (5) of the sleeper (2) until they reach the region between the two rails (9,9'), so that the outlets are next to one another and laterally at a distance from the back (5) of the sleeper (2) whose load transfer region is to be strengthened,
5) the outlets are optionally closed and
6) the outlets of the distributing pipes are guided to another sleeper and the process (steps 2) to 6)) is repeated at this sleeper.

* * * * *